United States Patent [19]

Senesac

[11] 4,267,652

[45] May 19, 1981

[54] DREDGING SYSTEM AND APPARATUS

[76] Inventor: Joseph Senesac, P.O. Box 2462, Ft. Myers, Fla. 33902

[21] Appl. No.: 34,050

[22] Filed: Apr. 27, 1979

[51] Int. Cl.[3] ..... E02F 3/88

[52] U.S. Cl. ..... 37/66; 37/189

[58] Field of Search ..... 37/57, 64–67, 37/189, 190

[56] References Cited

U.S. PATENT DOCUMENTS

| | | | |
|---|---|---|---|
| 293,932 | 2/1884 | Angell | 37/67 |
| 331,861 | 12/1885 | Bolles | 37/67 |
| 363,796 | 5/1887 | Bostrom | 37/66 |
| 532,183 | 1/1895 | Pike | 37/66 |
| 903,210 | 11/1908 | Lkiericz | 37/66 |
| 2,634,962 | 4/1953 | Eglitis | 37/64 X |
| 3,230,647 | 1/1966 | Gates | 37/190 |
| 3,476,498 | 11/1969 | Von Bolhar | 37/66 X |
| 3,588,174 | 6/1971 | Rossfelder et al. | 37/57 X |
| 3,605,296 | 9/1971 | Dysart | 37/66 X |
| 3,614,837 | 10/1971 | Araoka | 37/66 X |
| 3,690,023 | 9/1972 | Peterson | 37/190 X |
| 3,738,029 | 6/1973 | Harmon | 37/66 |
| 3,919,790 | 11/1975 | Sasaki et al. | 37/66 |

FOREIGN PATENT DOCUMENTS

| | | | |
|---|---|---|---|
| 1484781 | 4/1969 | Fed. Rep. of Germany | 37/66 |
| 2413738 | 10/1974 | Fed. Rep. of Germany | 37/66 |
| 1383089 | 2/1975 | United Kingdom | 37/72 |

*Primary Examiner*—Clifford D. Crowder
*Attorney, Agent, or Firm*—Morris Liss

[57] ABSTRACT

A dredging assembly pivotally suspended by a boom from a floating vessel includes an underwater frame that is propelled by rotation of spaded wheels to exert a forward propelling force on excavating drums mounted at a forward end of the frame. The drums are rotated independently of the propelling wheels in a direction opposite thereto during forward travel. Fixed baffles within the drums confine excavated material for removal by suction pressure.

1 Claim, 13 Drawing Figures

Fig. 1
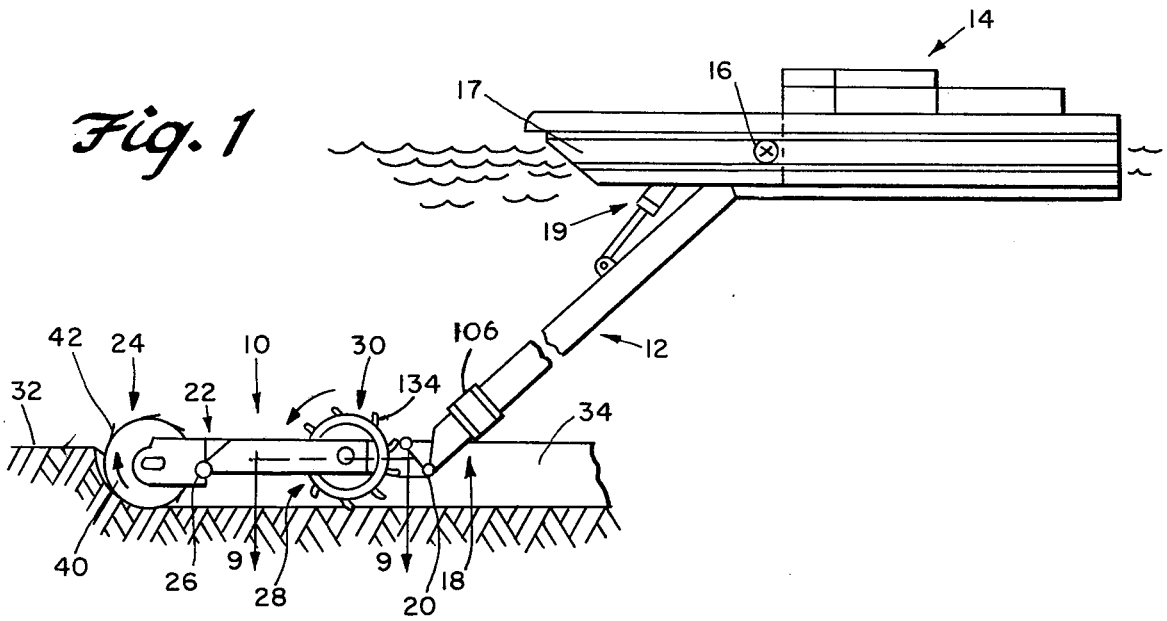
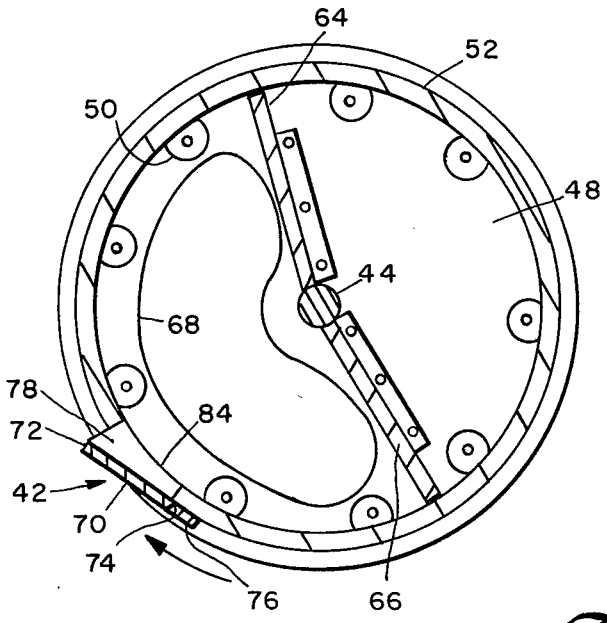
Fig. 5

DREDGING SYSTEM AND APPARATUS

BACKGROUND OF THE INVENTION

This invention relates to dredging systems in general and more particularly to improved equipment for removal of material from the bottom of a body of water.

Dredging apparatus often includes a boom or ladder pivotally suspended from a floating vessel to guide underwater movement of an excavating head along a bottom surface. According to one type of dredging system, the excavating head is in the form of a drum rotated in one direction to pick up mud, sand, gravel or other material. The excavated material is collected within the drum and removed therefrom by suction pressure through a conveying conduit extending up the ladder to the floating vessel for discharge. Dredging systems of the foregoing type are disclosed, for example, in U.S. Pat. Nos. 362,796, 903,210, 3,476,498 and 3,614,837.

Travel of the excavating head along the bottom surface is confined to an arcuate path about an anchoring spud according to each of the foregoing patents. Also, according to U.S. Pat. No. 363,685 to Bostrom, the drum is formed by two conical sections extending axially from a central suction manifold to which the material conveying conduit is connected. According to U.S. Pat. Nos. 903,210, 3,476,497 and 3,614,837, scooping elements project from the drum to displace the excavated material into partitioned collecting spaces within the drum. The drum in each case is supported for rotation about an axis fixed to the lower end of the boom or ladder.

Excavating heads that are not confined to arcuate travel during operation, are also known. U.S. Pat. No. 3,919,790 to Sasaki et al discloses, for example, an underwater traveling frame pivotally connected to the lower end of a towing boom. The frame rotatably mounts a bucket wheel between skids for raking material into a separate suction receiver. An underwater travelling frame for a digging wheel pivotally connected to the lower end of a pushing boom is disclosed in German Pat. No. 2,413,738. A pivotally supported traveling frame for an above surface excavating head is disclosed, on the other hand, in U.S. Pat. No. 3,690,023. In each case, forward travel of the excavating head is effected by towing or pushing.

The underwater dredgers exemplified by the disclosures in the aforementioned prior patents involve relatively large excavating heads at the lower end of the boom which gravitationally exert the requisite digging pressure and require cable-winch systems for lowering and raising the boom under the massive load of the excavating head. Geared power connections to the excavating head are provided from a power source located on the floating vessel in order to rotate the excavating drum during an excavating operation. The propelling force is derived solely from the floating vessel either towing or pushing the excavating drum causing the excavating head to swing in an arc about a spud anchored to the bottom.

It is therefore an important object of the present invention to provide an underwater dredger which will fill an existing void between massive harbor units as aforementioned and very small portable dredgers.

A further object in accordance with the foregoing object is to provide a highly mobile and functionally flexible dredger capable of performing large and small dredging projects. Yet another object is to provide a dredger arrangement which will facilitate maintenance and repair work on the apparatus.

SUMMARY OF THE INVENTION

In accordance with the present invention, an underwater dredging head of the rotary drum type, is mounted at the forward end of a self-propelled traveling frame pivotally connected to the lower end section of a boom pivotally suspended from a floating vessel. Propelling wheels are pivotally mounted on the frame in rearward adjacency to the rotary drums for support of the frame on the bottom surface. The propelling wheels are located in forward adjacency to the pivot connection between the frame and the lower end section of the boom. The lower end section is angularly adjustable about the longitudinal axis of the boom. Hydraulic power devices adjustably establish the angular relationship between the frame and the boom about a pivotal axis parallel to the rotational axes of the rotary drums and the propelling wheels. The propelling wheels are biased into engagement with the bottom surface and are provided with soil engaging spade elements to enhance their propelling action.

BRIEF DESCRIPTION OF THE DRAWING FIGURES

FIG. 1 is a simplified, partial side elevation view of a dredger installation in accordance with the present invention.

FIG. 5 is a transverse section view taken substantially through a plane indicated by section line 5—5 in FIG. 4.

DETAILED DESCRIPTION OF SPECIFIC EMBODIMENT

Figure 2:
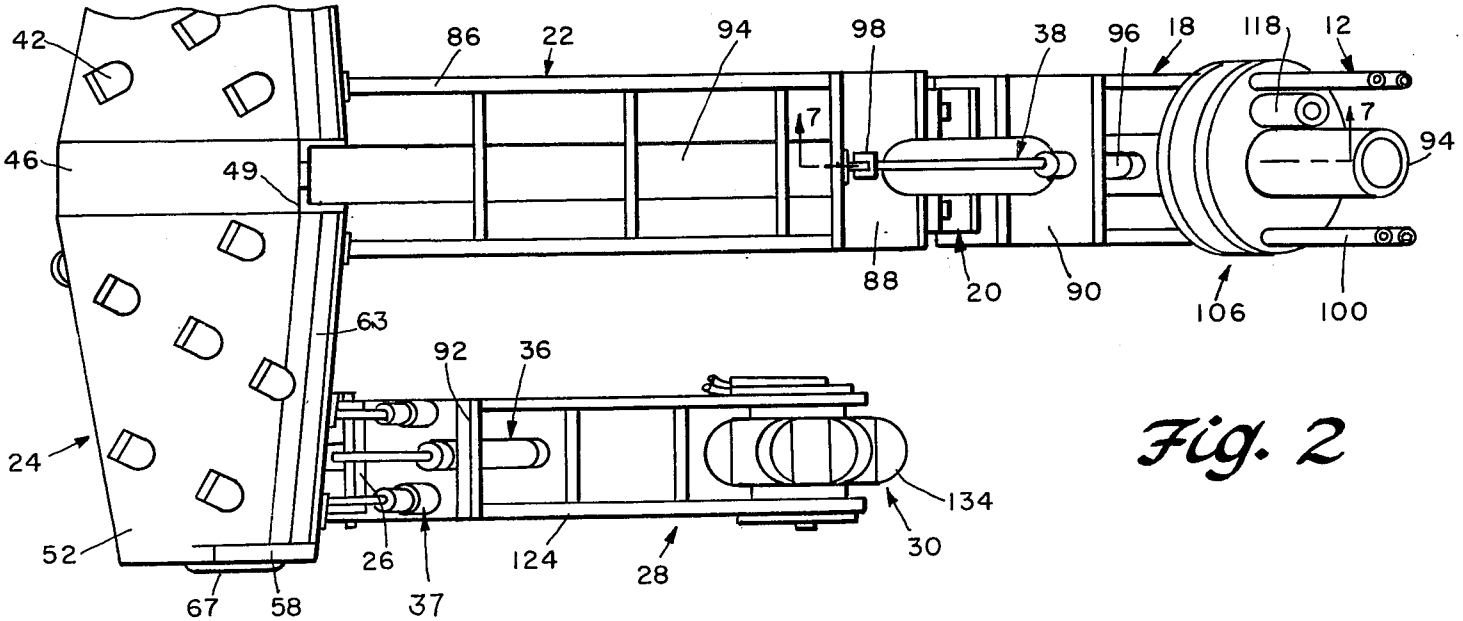
FIG. 2 is an enlarged, partial top plan view of the dredger apparatus shown in FIG. 1.

FIG. 1 illustrates somewhat schematically, in side elevation, an underwater dredging assembly generally referred to by reference numeral 10. The dredging assembly is connected to the lower end of a boom or ladder generally referred to by reference numberal 12. The ladder is pivotally suspended from a floating vessel generally referred to by reference numeral 14. As is well known in the art, the floating vessel mounts the necessary equipment for lowering and raising the dredging assembly, suction pumps for discharging material excavated by the dredging assembly, and a source of power for operating the moving components of the dredging assembly as well as to propel the floating vessel for movement of the dredging assembly to a desired location. The boom 12 is adapted to be hydraulically lowered or elevated relative to a pivot point 16 on the floating vessel between laterally spaced pontoons 17, by means of any suitable hydraulic power means 19.

In accordance with the present invention, the boom 12 has a lower end section 18 adapted to be rotatably adjusted about its longitudinal axis, and is provided with a pivot assembly 20 at its lower end to which the dredging assembly 10 is connected for angular adjustment about an axis perpendicular to the longitudinal axis of the boom. The dredging assembly 10 includes a main frame assembly generally referred to by reference numeral 22 pivotally connected at is rear end to the pivot assembly 20. The main frame assembly rotatably mounts at its forward end, an excavating or digging drum assembly generally referred to by reference numeral 24. The drum assembly is supported by the main frame assembly for rotation about an axis transverse to the direction of travel of the frame assembly. The rotational axis of the drum assembly 24 is furthermore parallel to the pivotal axis of the pivot assembly 20 and a pivotal axis common to a pair of pivot connections 26 to a pair of propelling assemblies 28 on opposite lateral sides of the main frame assembly 22. The propelling assemblies 28 extend rearwardly from the pivot connections 26 and respectively mount at their rear ends propelling wheels 30 rotatable about movable axes. The wheels 30 are located just forwardly of the pivot assembly 20 and are supported on the main frame 22 by the pivot connections 26 for angular adjustment relative to the main frame. Each propelling assembly is also biased downwardly relative to the main frame assembly for engagement with the bottom surface, such as a river bed being dredged. As shown in FIG. 1, the wheels 30 engage the bottom surface 32 within a trench 34 being excavated by the drum assembly 24 during operation.

Figure 3:
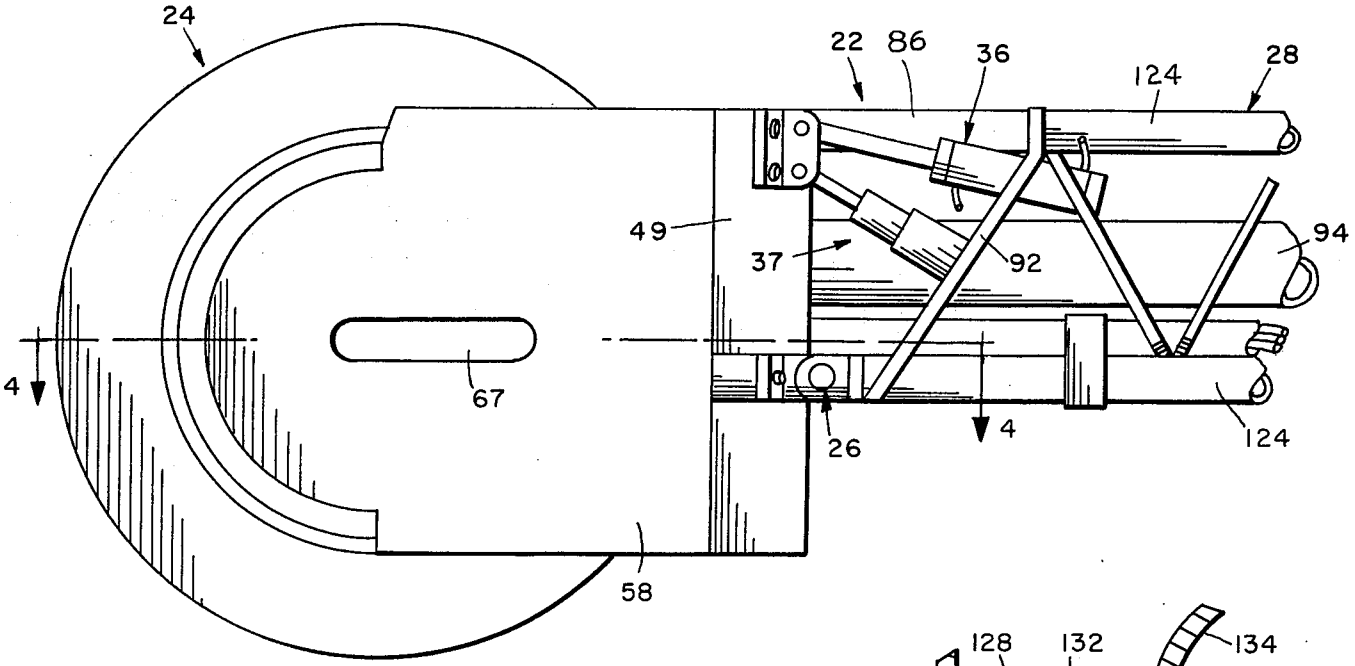
FIG. 3 is an enlarged side elevation view of a portion of the dredger shown in FIG. 2.
Figure 10:
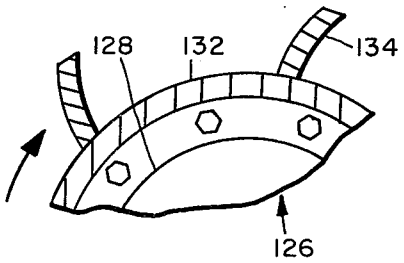
FIG. 10 is an enlarged partial section view taken substantially through a plane indicated by section line 10—10 in FIG. 9.

As seen in FIGS. 2 and 3, hydraulic devices 36 interconnected between the main frame assembly 22 and the propelling assemblies 28, limit the relative angular relationship between each propelling assembly 28 and the main frame assembly 22 to which the assembly 28 is biased by spring biasing devices 37. The adjusted angular relationship between the main frame assembly 22 and the boom 12, on the other hand, is established by a hydraulic positioning device 38 interconnected between the main frame assembly 22 and the lower end section 18 of the boom. By means to be described in detail hereinafter, the excavating drum assembly 24 is rotated in a clockwise direction as indicated by arrow 40 in FIG. 1 so that material is scooped up at the front end of the drum assembly by scoop elements 42 projecting therefrom. This excavating action is effected during self-propelled forward travel of the dredging assembly without any restraint of an anchoring spud as in the case of many prior art dredging arrangments. Forward travel of the rotating drum assembly 24 is induced by rotation of the wheels 30 in a counterclockwise direction as viewed in FIG. 1. The propelling wheels 30 not only impart a propelling force to the main frame assembly 22 and the rotating drum assembly 24 but also augment the digging pressure applied to the bottom surface by the scoop elements 42. The magnitude of the propelling and digging forces applied by the propelling wheels 30 will depend upon the adjusted bias exerted on the assembly 28 by the biasing devices 37 and by the torque applied to the propelling wheels. As will be explained hereinafter in detail, rotational torque is applied to the drum assembly 24 and the propelling wheels 30 independently of each other by self-contained powered means. Further, during the excavating operation, the drum assembly 24 and propelling wheels 30 are rotated in opposite directions as shown in FIG. 1. The rotational direction of the propelling wheels 30 may be reversed if desired in order to propel the dredging assembly 10 in a reverse direction for repositioning thereof while the drum assembly 24 is non-operational.

Figure 4:
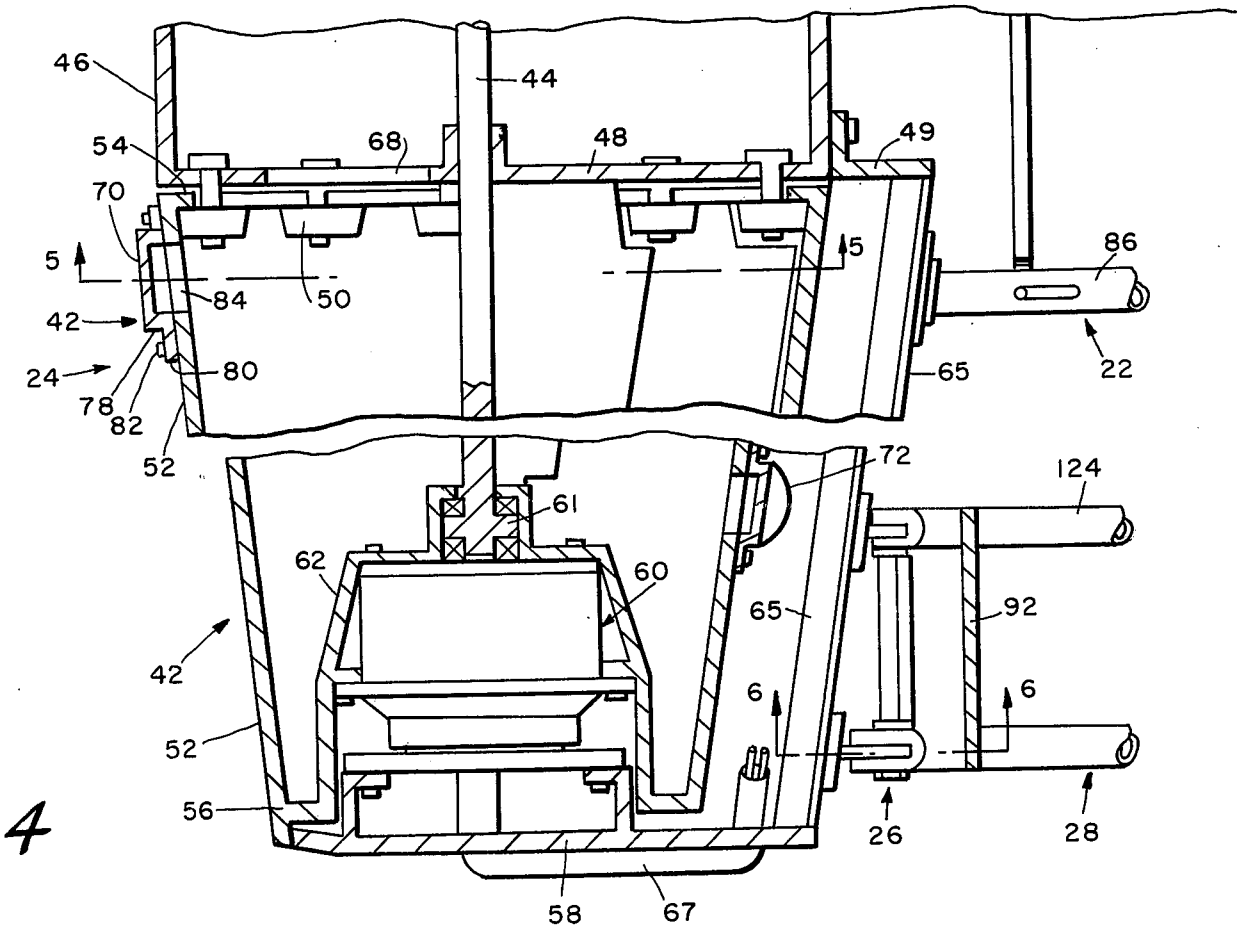
FIG. 4 is a partial section view taken substantially through a plane indicated by section line 4—4 in FIG. 3.

Referring now to FIG. 4 in particular, the excavating drum assembly 24 is supported for rotation about its rotational axis on the main frame 22 by an elongated support axle 44 extending perpendicular to the longitudinal axis of the frame assembly. Positioned on the axle intermediate its opposite ends is an annular manifold member 46 closed at opposite axial ends by side walls 48. Brackets 49 are secured to and extend rearwardly from the manifold member 46 for connection to the main frame assembly 22. Each of the side walls 48 mounts rollers 50 for rotatably supporting conical drum sections 52 on opposite lateral sides of the manifold member 46. The scoop elements 42 are mounted on and project from each of the drum sections 52 and are arranged thereon along spiral paths. The rollers 50 engage the adjacent large diameter ends 54 of the conical drum sections while the small diameter ends 56 of the drum sections are closed by end shield support plates 58 affixed to the main frame 22 and the stationary portions of fluid motor drive units 60. Fluid drive units of this type are well known as disclosed, for example, in U.S. Pat. No. 3,762,488. The inner ends of the drive units 60 abut the ends 61 of the axle 44 within the small diameter end portions of the conical drum sections 52. The end support plates 58 and inwardly extending enclosure portions 62 of the conical drum sections protectively enclose the fluid drive units within the conical drum sections. The plates 58 also extend rearwardly from the drum sections to mount upper and lower cross frame members 63 and 65 for support of the pivotal connections 26 for the propelling assemblies 28.

The fluid drive units 60 are energized by pressurized fluid circulated therethrough by means of conduit assemblies 67 from a pump (not shown) on the floating vessel. Both drive units 60 may be controlled in a manner well known in the art so as to drive the two drums 52 in the same direction and at the same speed in an excavating mode of operation during forward travel. The fluid drive units may also be driven at differential speeds in order to effect forward travel in a changing direction.

Secured to the stationary side wall 48 within each of the conical drums 52, are a pair of baffle members 64 and 66 partitioning the drum chamber as shown in FIG. 5. An opening 68 is formed in each of the side walls 48 in order to establish fluid communication between each of the drum chambers and the suction manifold chamber. The suction pressure applied to the interior of each conical drum through an opening 68 is thereby confined to a limited forward zone of somewhat more than 180° about the axle 44 as shown in FIG. 5, because of the angular positioning of the fixed baffles 64 and 66. It is this limited zone of the drum chamber into which material is displaced by the scoop elements 42 during rotation of the drum.

As more clearly seen in FIGS. 4 and 5, each of the scoop elements 42 includes a blade portion 70 which extends tangentially from the outer surface of the conical drum 52 so as to present an arcuate digging edge 72. The opposite anchor edge 74 of the blade member 70 is bevelled for abutment with a shoulder projection 76 welded to the external surface of the drum. The sides 78 of the blade member 70 are provided with flanges 80 as more clearly seen in FIG. 4, by means of which the scoop element is secured to the drum. Fasteners 82 thus secure the flanges 80 to the drum as shown. Each blade member 70 overlies an opening 84 formed in the drum through which the material excavated enters the drum chamber forwardly of the fixed baffle members 64 and 66 as aforementioned. The excavated material will then be withdrawn from the drum by means of suction pressure into the suction chamber enclosed by the manifold member 46.

Figure 6:
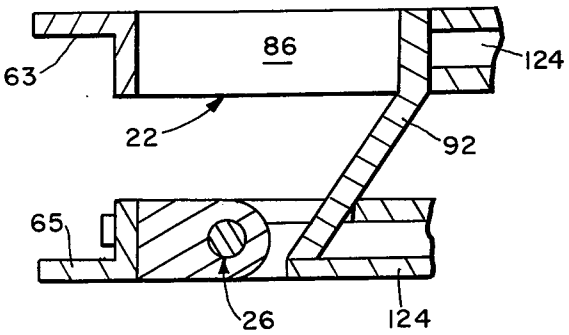
FIG. 6 is an enlarged partial section view taken substantially through a plane indicated by section line 6—6 in FIG. 4.
Figure 7:
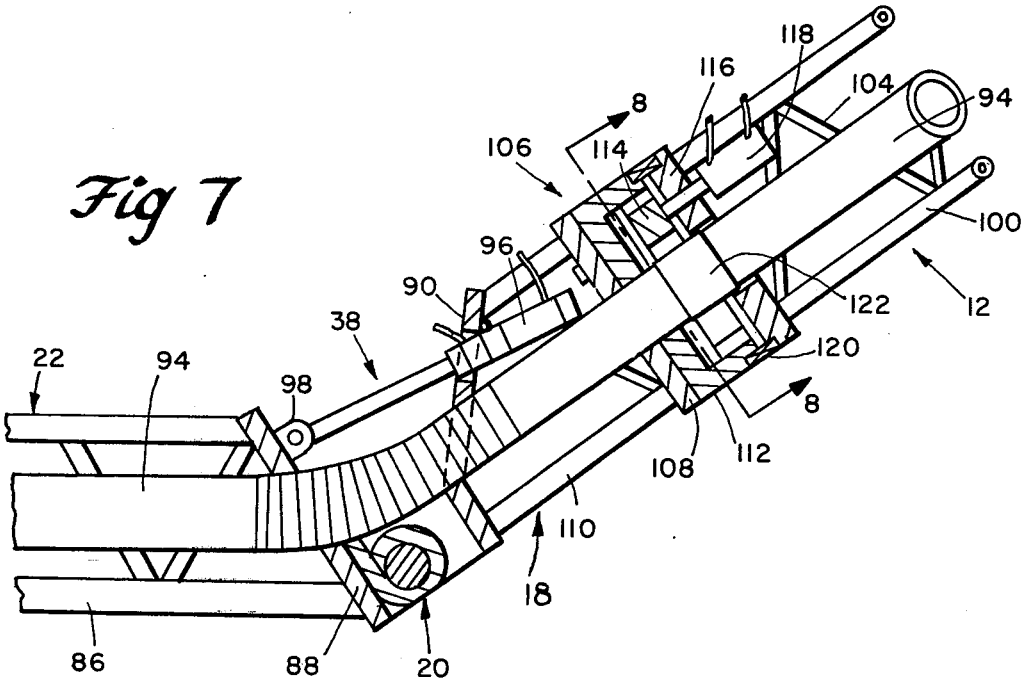
FIG. 7 is an enlarged partial section view taken substantially through a plane indicated by section line 7—7 in FIG. 2.
Figure 8:
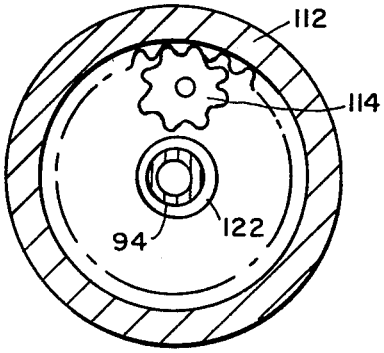
FIG. 8 is a transverse section view taken substantially through a plane indicated by section line 8—8 in FIG. 7.

The main frame 22 may be of any suitable construction. By way of example, the embodiment illustrated includes four tubular frame members 86 that are secured at their forward ends to the cross frame members 63 and 65. The lower cross frame members 65 also support the pivot connections 26 for the propelling assemblies 28 just rearwardly of the drum assembly 24 and slightly below its rotational axis as more clearly seen in FIGS. 3 and 6. The annular manifold member 46 is connected to a suction conveying conduit 94 that extends through the main frame assembly 22 and up the boom 12 to the floating vessel as more clearly seen in FIG. 7.

The pivot assembly 20 is mounted on a rear end plate 88 of the main frame 22 to interconnect it with an end plate 90 of the lower section 18 of the boom. As more clearly seen in FIG. 7, the angular position between the boom and the main frame assembly 22 is established by the hydraulic positioning device 38 which includes a hydraulic cylinder 96 pivotally anchored to the end plate 90 of the lower boom section. A piston rod extending from the cylinder 96 is pivotally connected to the main frame assembly by a clevis connection 98 on the end plate 88 of the main frame assembly.

The boom assembly 12 may be of any suitable construction. In the illustrated embodiment, the boom is similar in construcion to the main frame and includes four tubular frame members 100 parallel to the longitudinal axis of the boom. The tubular frame members 100 may be interconnected by bracing rods 104. The lower boom section 18 is made of a similar construction but is angularly rotatable relative to the main section of the boom about its longitudinal axis. Toward that end, a swivel joint assembly 106 interconnects The lower section 18 and the main section of the boom. The swivel assembly 106 includes the end plate 108 to which the tubular frame members 110 of the lower boom section are connected. The end plate 108 is connected to an internal gear member 112 in mesh with a pinion 114 rotatably mounted by an end plate member 116 secured to the tubular frame members 100 of the main boom section. The end plate 116 mounts a fluid drive motor 118 to which the pinion 114 is connected. A thrust bearing and seal assembly 120 is positioned between the gear 112 and the end plate member 116 in order to accommodate relative angular rotation as well as to transmit axial thrust. Because of the relative angular rotation, the suction conveying conduit 94 may be made up of separate sections interconnected by a swivel coupling 122 of any well known construction. It will therefore be appreciated that the fluid motor 118 may be operated through a servo control system well known in the art to adjust the angular position of the dredging assembly 10 relative to the longitudinal axis of the boom 12 from which it is pivotally suspended. In this manner, the angular orientation of any trench being cut by the dredging assembly may be adjusted as desired.

Figure 9:
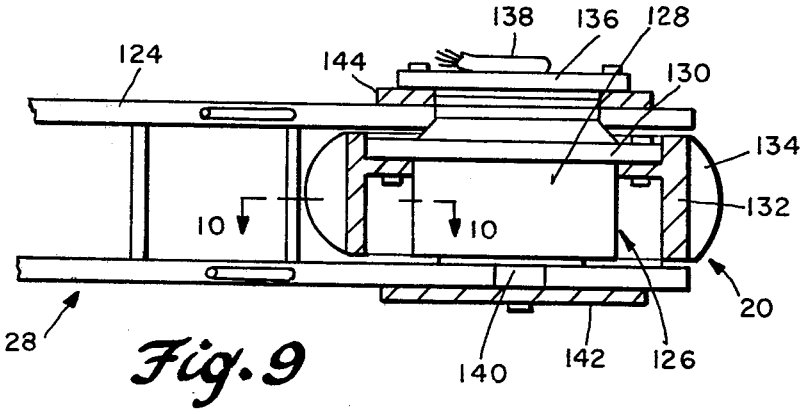
FIG. 9 is an enlarged partial section view taken substantially through a plane indicated by section line 9—9 in FIG. 1.

As more clearly seen in FIG. 3, adjustment of the angular position of each propelling assembly 28 is effected through a hydraulic device 36 as aforementioned. Each propelling assembly 28 includes a supporting subframe of a construction similar to that of the main frame including an end plate 92 pivotally anchoring the cylinder of hydraulic device 36 and four tubular frame members 124 extending rearwardly from the pivot connection 26 and end plate 92 for rotatably supporting one of the propelling wheels 30. Each propelling wheel 30 is independently driven by a fluid motor drive unit 126 as more clearly seen in FIG. 9, similar to the fluid drive units 60 associated with each of the drum sections 52. Each of the drive units 126 as shown may be of a construction as disclosed in detail in U.S. Pat. No. 3,762,488 aforementioned, and includes a rotary housing 128 having a flange 130 to which a wheel rim 132 is secured. Spade elements 134 project from the wheel rim and are curved in the direction of forward rotation for engagement with the bottom surface. The rotary housing of the fluid drive unit is rotatably mounted on a stationary junction block 136 of the drive unit from which a fluid conduit assembly 138 extends to the floating vessel. The junction block 136 is connected to a valve block 140 within the drive unit 126. Anchor plates 142 and 144, secure the stationary juncture block and valve block to the frame members 124 at opposite axial ends of the drive unit 126. The drive units 126 are energized for rotation of the propelling wheels in forward and reverse directions and may also be differentially driven as in the case of drive units 60 associated with the drum sections 52 in order to effect a change in direction of travel. Operation of all four drive units 60 and 126 may be controlled through a common fluid control system in the floating vessel in a manner well known in the art. During forward travel, the drive units 126 cause rotation of the spaded wheels 30 in a counterclockwise direction as viewed in FIG. 1 in order to cause the spade elements 134 to effectively engage the bottom surface.

Figure 11A:
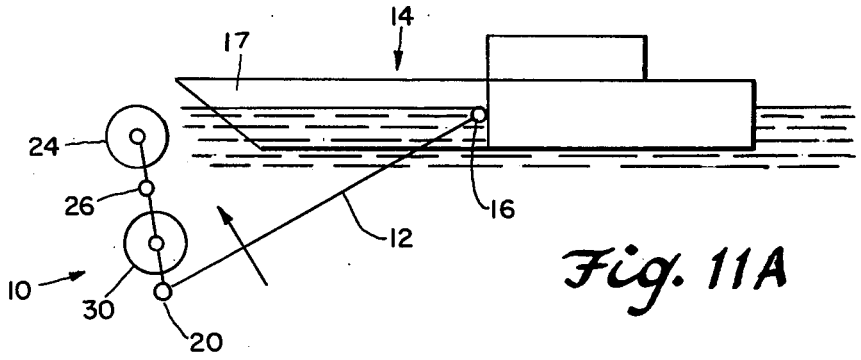
FIGS. 11A, 11B and 11C are kinematic representations of the dredging system in different stages during movement to a non-operational retracted position.
Figure 11B:
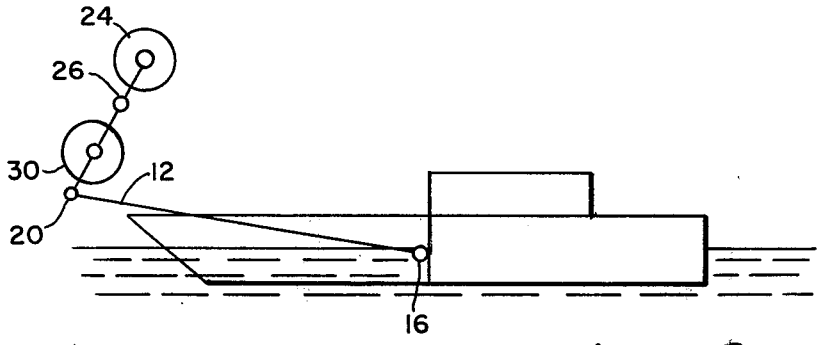
Figure 11C:
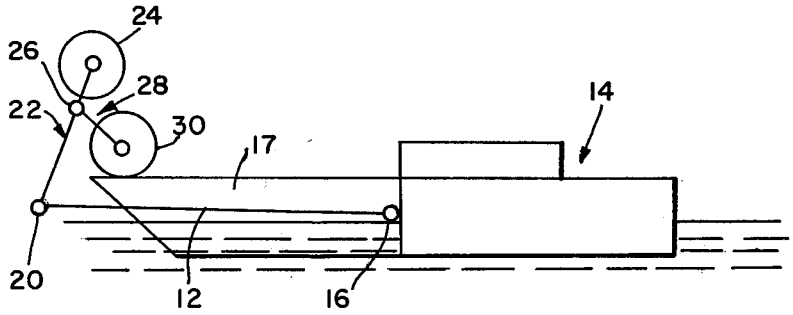

In FIG. 1 the dredging assembly 10 is shown in its operational mode cutting a trench in the bottom surface. When inoperative, the dredging assembly may be pivoted upwardly about pivot 20 and the boom 12 elevated as shown in FIG. 11A to raise the dredging assembly out of the water above the deck of the vessel 14 to the position shown in FIG. 11B. The propelling assemblies 28 may then be swung rearwardly about the pivots 26 and the boom 12 lowered somewhat in order to bring the wheels 30 into positions resting on the pontoon decks for support of the dredging assembly on the vessel at its bow end as shown in FIG. 11C. In this fashion, the dredging assembly may be safely transported to a desired dreding location and conveniently positioned on the deck of the vessel for repair and maintenance by a work crew.

What is claimed is:

1. In combination with a vessel floating on a body of water and a boom pivotally suspended from the vessel within said body of water, a dredging assembly for excavating material from a bottom surface, during travel in one direction, comprising a frame pivotally connected to said boom, rotary digging means mounted by the frame for rotation about a rotational axis transverse to said direction of travel, propelling wheel means pivotally mounted on the frame in spaced relation to the digging means for engagement with the bottom surface, powered means connected to the digging means and the propelling wheel means for rotation thereof to respectively excavate a trench and exert a propelling force on the frame in the direction of travel, means biasing the propelling wheel means in a direction maintaining the wheel means in engagement with the bottom surface, and means for displacing the propelling wheel means and the digging means from submergence in water to a position on board the vessel, the displacing means comprising:

means connected between the vessel and the boom for rotating the boom in and out of water;

means connected between the boom and the frame for rotation therebetween;

means connected between the frame and the propelling wheel means for rotation therebetween.

* * * * *